US006014803A

United States Patent [19]

Lewin

[11] Patent Number: 6,014,803

[45] Date of Patent: Jan. 18, 2000

[54] THERMAL TRIGGERING SYSTEM

[75] Inventor: Rainer Lewin, Berlin, Germany

[73] Assignee: Siemens AG, Munich, Germany

[21] Appl. No.: 09/091,445

[22] PCT Filed: Dec. 9, 1996

[86] PCT No.: PCT/DE96/02356

§ 371 Date: Jun. 17, 1998

§ 102(e) Date: Jun. 17, 1998

[87] PCT Pub. No.: WO97/23887

PCT Pub. Date: Jul. 3, 1997

[30] Foreign Application Priority Data

Dec. 22, 1995 [DE] Germany ..... 195 48 479

[51] Int. Cl.[7] ..... H01H 69/02

[52] U.S. Cl. ..... 29/623; 29/622; 337/62; 337/49; 337/36

[58] Field of Search ..... 29/623, 622, 593, 29/592.1; 337/49, 46, 45

[56] References Cited

U.S. PATENT DOCUMENTS

| | | | |
|---|---|---|---|
| 4,691,184 | 9/1987 | Wulff | 337/49 |
| 4,806,897 | 2/1989 | Fahner et al. | 337/49 |

FOREIGN PATENT DOCUMENTS

| | | |
|---|---|---|
| 159 598 | 10/1985 | European Pat. Off. . |
| 31 49 811 | 7/1983 | Germany . |
| 34 01 901 | 8/1985 | Germany . |
| 41 33 475 | 4/1992 | Germany . |

*Primary Examiner*—Lee Young
*Assistant Examiner*—Sean Smith
*Attorney, Agent, or Firm*—Kenyon & Kenyon

[57] ABSTRACT

A thermal triggering system includes bimetal strips a switching element for triggering a switching operation, and a differential lever which is fastened to the slide and which shortens its distance from the switching element as a result of the movement of said slide in the pushing direction, the mounting of the differential lever on the slide is improved in terms of adaption to the distance. For this purpose, the differential lever is fastened via a bearing point which is designed as a center of rotation and via which the distance can be set at a predetermined distance value.

1 Claim, 1 Drawing Sheet

THERMAL TRIGGERING SYSTEM

FIELD OF THE INVENTION

The present invention relates to a method for producing a thermal triggering system for an electric switchgear. The electric switchgear includes bimetal elements.

The invention relates to a thermal triggering system for an electric switchgear, the bimetal strips, with a slide having receptacles, in which the bimetal elements are received, a switching element for triggering a switching operation, and a differential lever which is fastened to the slide and which shortens its distance from the switching element as a result of the movement of said slide in the pushing direction, the differential lever being fastened to the slide via a first and a second bearing point.

BACKGROUND INFORMATION

Conventional thermal triggering systems are produced for power switches. Here, a deflection of three bimetal strips as a result of overload currents is utilized for a switching operation. The switch is not actuated directly, but via the slide which is adapted to the position of the bimetal strips. The differential lever is pressed against the switching element by the slide and thus triggers the switching operation. The components of the switchgear have unavoidable tolerances and, in terms of their arrangement and interaction, form a tolerance chain. The effect of this has to be compensated on the ready-assembled switch. It has therefore been customary until now to make the position of the switching element adjustable. Adjustment was carried out via a fine thread screw, using which it was possible to set forward or backward a pivotably mounted carrier for the switching lever. It was thereby possible for the distance between the switching element and the differential lever to be set at a predetermined value a.

A conventional thermal triggering system for an electric switchgear is described in U.S. Pat. No. 4,691,184. The conventional thermal triggering system includes calibrating or adjusting elements.

SUMMARY OF THE INVENTION

An object according to the present invention is to improve a method for producing a thermal triggering system by dispensing with adjusting elements used until now, thus reducing costs. The object of the present invention is achieved in that the slide is produced together with the first bearing point designed as a center of rotation, in that the position of the switching element in the electric switchgear is measured, and in that the second bearing point is calculated as a function of the measured position of the switching element and is executed on the slide which is thereupon mounted in the associated switchgear.

DETAILED DESCRIPTION OF THE INVENTION

Figure 1:
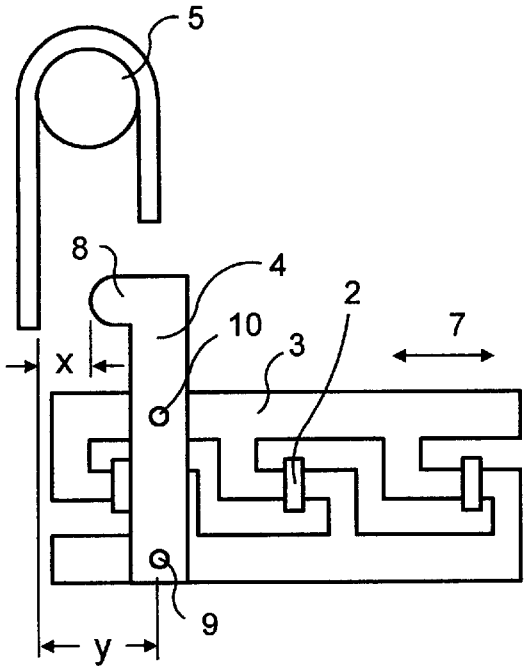
FIG. 1 shows a thermal triggering system without an adapted switching travel according to the present invention.
Figure 2:
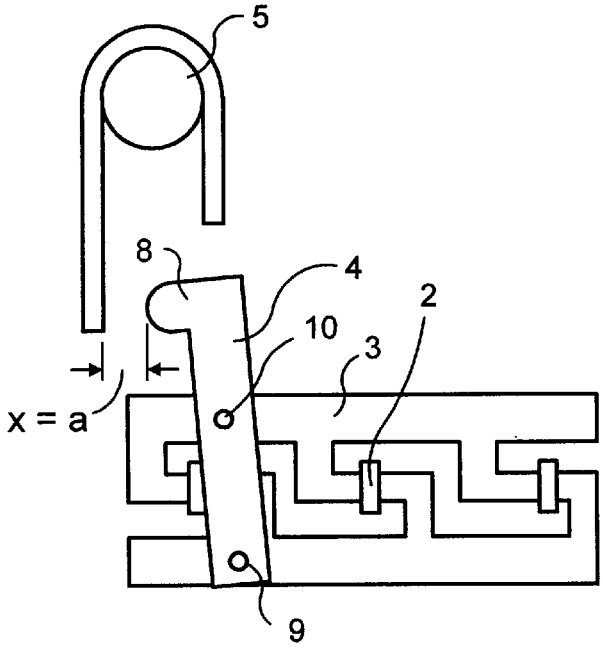
FIG. 2 shows the thermal triggering system with the adapted switching travel.

Power switches are equipped with a thermal triggering system 1 for protection against overcurrents. The thermal triggering system according to FIG. 1 comprises three bimetal strips 2, which are each provided with a heating winding (not shown), a slide 3, a differential lever 4 and a switching element 5. Receiving slots 6, in which the bimetal strips 2 are inserted, are worked in the slide 3. The slide 3 can be displaced in the pushing direction, indicated by double arrow 7, as a result of the deflection of one or more bimetal strips 2 when overload currents occur. The differential lever 4 oriented essentially transversely to the pushing direction is fastened to the slide 3, said differential lever having a nose 8 at its end facing the switching element 5. This nose 8 is at a distance x from the switching element 5 in the pushing direction, said distance being dependent on the temperature of the bimetal strips 2, i.e., the heating caused by the load current. In the currentless state, this distance x is to have a definite value a. The differential lever 4 is fastened to the slide 3 via two bearing points 9, 10. The first bearing point 9 is a point which is fixed relative to the slide 3 and which, in the currentless state, is at a distance y from the switching element 5 in the pushing direction. This distance y is different from switchgear to switchgear as a function of the manufacturing tolerances, i.e., is of a magnitude specific to the switchgear. The second bearing point 10 of the differential lever 4 is fixed as a function of the distance y, so that the nose 8 of the differential lever 4 has the distance value x=a from the switching element 5 in the pushing direction according to FIG. 2.

The two bearing points 9, 10 are preferably located on a straight line oriented essentially transversely to the pushing direction. The bearing point 9 which, in this case, is located further away from the switching element 5 serves expediently as a fixed center of rotation. This allowing, using small angles of rotation, to adapt the second bearing point 10 of the differential lever 4 to the prescribed position which results in the required distance value x=a of the nose 8 from the switching element 5 in the pushing direction.

This yields the following method for producing the slide 3. In the first place, the slide 3 is manufactured with only one bearing point 9 which serves as a center of rotation. The position of the switching element 5 in the triggering system 1 is measured, this being possible with great accuracy by triggering the switching operation. The position of the second bearing point 10 is calculated as a function of this, said bearing point being produced, for example, by punching. The slide 3 is subsequently mounted in the associated switchgear. The second bearing point is designed as a slot 10 according to FIG. 2.

I claim:

1. A method for producing a thermal triggering system for an electric switchgear, comprising the steps of:

providing a bimetal element;

providing a slide having a receptacle, the receptacle receiving the bimetal element;

providing a switching element for triggering a switching element, the switching element being provided in the electric switchgear;

measuring a position of the switching element in the electric switchgear;

fastening a differential element to the slide via first and second bearing points, the slide shortening a distance between the differential element and the switching element by moving the slide in a first direction, the first bearing point being a center of rotation of the differential element on the slide, and the second bearing point being determined as a function of the measured position; and mounting the slide in the electric switchgear.

* * * * *